US011214986B2

(12) United States Patent
Emma et al.

(10) Patent No.: US 11,214,986 B2
(45) Date of Patent: Jan. 4, 2022

(54) EMERGENCY DEADBOLT DEVICE

(71) Applicant: DEFCON PRODUCTS, LLC, Sterling, MA (US)

(72) Inventors: Amy Jo Emma, Sterling, MA (US); Salvatore Emma, Jr., Sterling, MA (US)

(73) Assignee: DEFCON PRODUCTS, LLC, Venice, FL (US)

( * ) Notice: Subject to any disclaimer, the term of this patent is extended or adjusted under 35 U.S.C. 154(b) by 553 days.

(21) Appl. No.: 16/139,827

(22) Filed: Sep. 24, 2018

(65) Prior Publication Data

US 2019/0323266 A1 Oct. 24, 2019

Related U.S. Application Data

(60) Provisional application No. 62/660,741, filed on Apr. 20, 2018.

(51) Int. Cl.

| | |
|---|---|
| ***E05B 65/00*** | (2006.01) |
| ***E05B 65/10*** | (2006.01) |
| ***E05B 9/02*** | (2006.01) |
| ***E05B 59/00*** | (2006.01) |
| ***E05B 55/00*** | (2006.01) |

(52) U.S. Cl.

CPC ..... *E05B 65/1086* (2013.01); *E05B 9/02* (2013.01); *E05B 55/005* (2013.01); *E05B 59/00* (2013.01)

(58) Field of Classification Search

CPC .... E05B 65/1086; E05B 89/02; E05B 55/005; E05B 59/00

USPC ..... 70/107

See application file for complete search history.

(56) References Cited

U.S. PATENT DOCUMENTS

| | | | | |
|---|---|---|---|---|
| 3,791,180 | A * | 2/1974 | Doyle | E05B 59/00 70/107 |
| 5,004,287 | A * | 4/1991 | Doyle | B62D 33/0273 16/260 |
| 5,829,801 | A * | 11/1998 | Tindall | E05B 7/00 292/336.3 |
| 6,595,561 | B1 * | 7/2003 | Szablewski | E05B 83/16 292/304 |
| 7,775,072 | B2 * | 8/2010 | Pullmann | E05B 15/101 70/208 |
| 8,814,233 | B2 * | 8/2014 | Leska | F16P 3/10 292/341.16 |
| 9,159,210 | B2 * | 10/2015 | Jones, Jr. | G08B 25/00 |
| 9,354,619 | B2 * | 5/2016 | Ergenbright | G08B 25/10 |
| 2004/0159134 | A1 * | 8/2004 | Eichenauer | E05B 47/0046 70/278.1 |

(Continued)

*Primary Examiner* — Suzanne L Barrett

(74) *Attorney, Agent, or Firm* — Juan Carlos A. Marquez; Marquez IP Law Office, PLLC

(57) ABSTRACT

A door deadbolt device that can prevent a door from opening operates independently from the lockset installed on the door. The device is easily locked from the inside of the room with a one-handed motion using an insertable tool or key which may be carried separately or stored out of the reach of small children or unauthorized persons. The bolt is positioned so as to be pushed into a locking position under the tension of a spring, thereby easily and securely bolting the door. The present invention further allows the user to rapidly unbolt the door from inside the room also with a one-handed single motion. Optionally, the device can also be unbolted from the outside with a special tool.

14 Claims, 16 Drawing Sheets

(56) References Cited

U.S. PATENT DOCUMENTS

| | | | | |
|---|---|---|---|---|
| 2014/0319850 | A1* | 10/2014 | Berger | E05B 15/101<br>292/177 |
| 2016/0230431 | A1* | 8/2016 | Yonekura | E05C 1/04 |
| 2021/0079694 | A1* | 3/2021 | Emma, Jr. | E05B 35/00 |

* cited by examiner

EMERGENCY DEADBOLT DEVICE

This application claims the priority of U.S. Provisional Application No. 62/660,741 filed on Apr. 20, 2018, the entire contents of which are incorporated herein by reference.

BACKGROUND OF THE INVENTION

1. Field of Invention

The present invention is in the technical field of door bolting and barricading devices. More particularly, the present invention is in the technical field of door deadbolt devices that allow rapid engagement and disengagement of the bolting mechanism from both the inside and the outside of a door using a special tool to prevent unauthorized persons from deploying the locking mechanism from the inside, while providing safety personnel the ability to unlock the door from the outside in an emergency.

2. The Prior Art

When an educational or other institution goes into a lockdown mode, the teacher or operator may have to locate a door key under stress and must open the door and step into the hallway in order to lock the door from the outside. This potentially places the classroom or other occupants at risk and can take critical time away from other lockdown procedures. In addition, it generally takes two hands and a good deal of dexterity under extreme stress to perform a door lock operation with a key from the outside. It would be beneficial to provide a device or means by which a teacher or operator can lock the door within a few seconds from the inside without the need to open the door, thereby eliminating the time it takes to find the door key, open the door, lock the door from the outside, and step back into the classroom, all steps that compromise the safety of both the teacher and the students in the room.

On the outside of the door, it is advantageous to provide disarming mechanism on such a device to allow a safety officer or other personnel quickly and optionally unbolt the door barricade device by means of a special tool. Other door barricade or bolting devices presently in the market do not provide for unlocking from outside the door, locking from inside the door with a tool possessed and controlled by the authorized user, and the ability to mount the door bolt mechanism in such a manner to be compliant with the present regulations of the Americans with Disabilities Act ("ADA") (generally 34-48 inches above the floor), and have unlocking controls which do not require grasping, pinching, twisting, or prior knowledge or training, are also in compliance with the ADA. It is advantageous to have a device which is mounted and operated separately from the existing door lock set hardware making it easy and inexpensive to install.

SUMMARY OF THE INVENTION

The present invention comprises a door deadbolt device that can prevent a door from opening which operates independently from a lockset installed on the door. The present invention is easily locked from the inside of the room with a one-handed motion using an insertable tool or key which may be carried separately or stored out of the reach of small children or unauthorized persons. The bolt is positioned so as to be pushed into a locking position under the tension of a spring, thereby easily and securely bolting the door. The present invention further allows the operator to rapidly unbolt the door from the inside also with a one-handed single motion. Optionally, the device can also be unbolted from the outside with a special tool.

By providing a device that can be operated one-handedly and without any special knowledge, the door can be bolted rapidly by anyone, even those with reduced fine motor skills, while providing a teacher or an operator the ability to rapidly and easily unbolt the door from inside the room. At the same time, in an optional embodiment, first responders or other authorized personnel can easily unbolt the door from the outside using the same or similar type of special tool or key, or even one specifically provided only to first responders or authorized personnel. The present invention is designed to be mounted on left- or right-handed swing doors and can be mounted at a height from the floor, as desired by the operator while being compliant with accessibility requirements for wheelchair-bound individuals.

Advantages of the present invention include, without limitation, the ability to rapidly bolt a door closed from the inside the room by inserting a removable key or tool into a bolt body mounted on the door with one hand, keeping the other hand free for using a cell phone, hitting an alarm button, pulling a shade, or moving items out of the way, etc.

Another advantage of the deadbolt device 100 of the present invention is that it can easily be mounted to standard-sized doors with metal or wooden door frames, and does not require any modification, re-designing or compromising of existing door hardware. As will be shown hereinbelow, parts of the deadbolt device 100 in at least one embodiment are mounted on the door or door frame with the appropriate mounting hardware, and thus would require drilling holes into the door and door frame for various purposes described below, as would be understood by those of skill in the art.

A further advantage of the invention is that it includes features such as a means for first responders or other authorized personnel to unbolt the door from the outside using a special key or tool, making the invention compliant with federal, state, local and even international building, fire, and safety regulations. The device of the present invention may also be installed at the proper height and position for wheelchair-bound or other disabled persons to operate it, thus complying with accessibility regulations. The device of the present invention is designed to be rapidly used with a single one-handed motion for bolting and unbolting, even under particularly stressful situations when fine motor skills and dexterity may be lacking.

BRIEF DESCRIPTION OF THE DRAWINGS

The present invention is illustrated in the accompanying drawings, wherein.

DETAILED DESCRIPTIONS OF THE INVENTION

The embodiments of the present invention will be described hereinbelow in conjunction with the above-described drawings. All illustrations of the drawings are for the purpose of describing preferred embodiments of the present invention and are not intended to limit the scope of the present invention.

The present invention is a deadbolt device that can only be operated by means of a special key or tool to engage the deadbolt thereby preventing the door from being opened from the outside by an intruder. The deadbolt device is designed to allow rapid engagement and disengagement of the bolting mechanism with a one-handed motion to insert the tool thereby pushing and locking the bolt into place, or with one motion to unbolt the device. The device unbolts by releasing tension on a spring engaged with the deadbolt. In the locked position, the deadbolt is held in the bolted position in a keeper under tension of the deadbolt spring by a spring loaded pin, lever, latch, or other means. The spring loaded pin, lever, latch, etc. can be actuated from the inside of the room to disengage the bolt from the keeper. Optionally, the deadbolt can be disengaged from outside of the room with the same or similar key or special tool used to engage the deadbolt. The key or tool pushes upon the spring loaded pin, lever, latch, or other means, thereby releasing tension on the deadbolt main spring and then pushing the deadbolt to the unbolted position. The deadbolt is retained in a deadbolt housing, allowing the removal and storage of the actuation/locking key or tool. The key or tool is intended to be kept out of reach of small children or other unauthorized persons, and to be used only when the door needs to be bolted by an authorized person.

Figure 1:
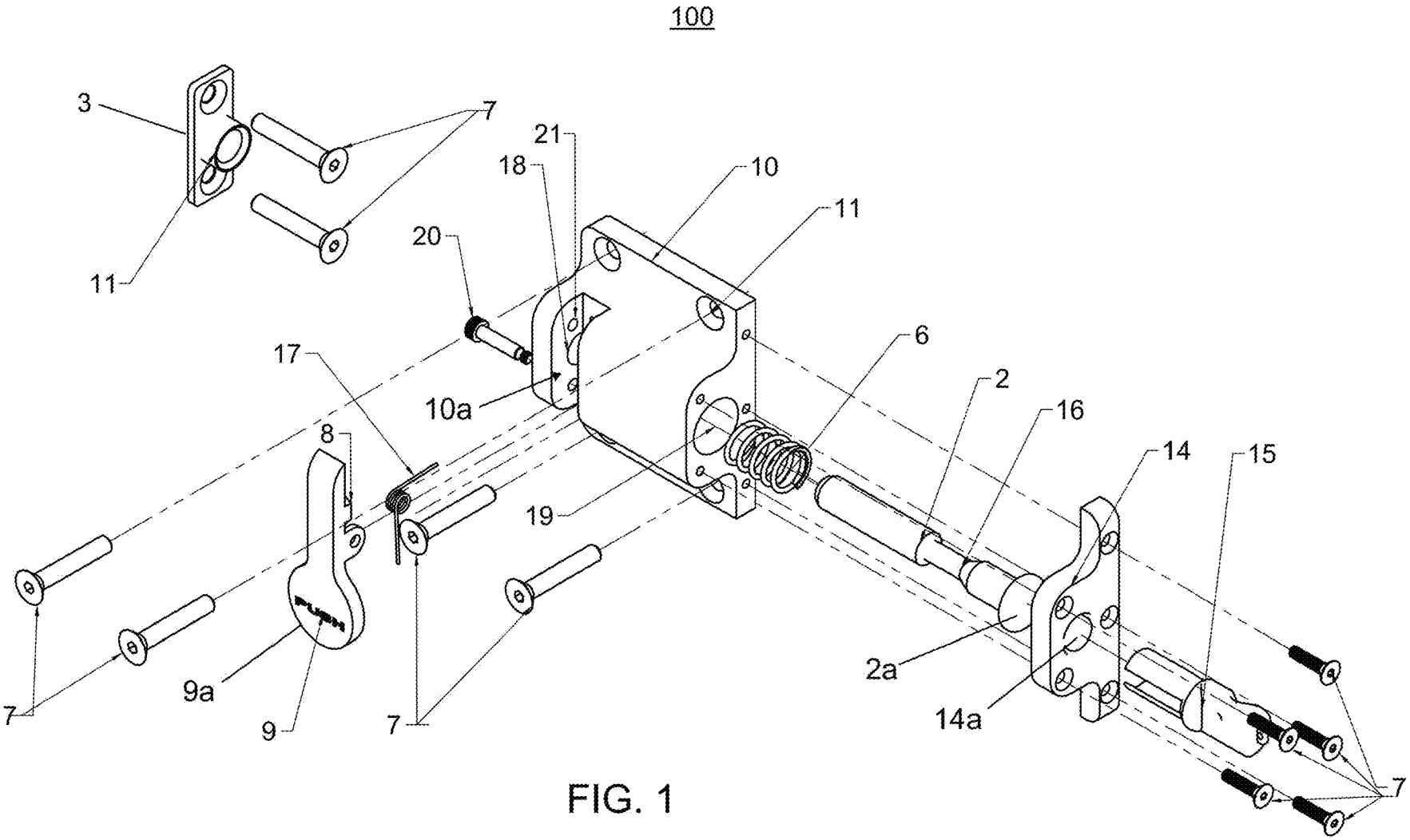
FIG. 1 illustrates a front exploded view of the deadbolt device system of the present invention.

Referring now to the invention in more detail, as shown in FIG. 1, in at least one embodiment, there is generally shown a deadbolt device 100 having an assembly housing 10 to be used with a door 1 (see FIG. 2A) having a removable key or tool 15 which is fitted through a tamper resistant plate 14; a deadbolt 2; a deadbolt keeper 3; a door unbolting lever 9; mounting hardware comprising metal screws 7, affixing through housing 10 and deadbolt keeper drill holes 11; an outside unlocking key tool 12; and an optional outside keyhole plate 13. The door unbolting lever 9 comprises a locking mechanism 8 capable of locking the deadbolt 2 in place under pressure from the deadbolt spring 6 which also secures the deadbolt 2 into its engaged position.

To lock the bolt, the removable key or tool 15 is inserted through the keyhole slot 14*a* in the tamper resistant plate 14 pushing against the activator 2*a* of the deadbolt 2 to slide the deadbolt 2 through a bore 19 in the assembly housing 10 under tension of the deadbolt spring 6, until it is locked into position when the locking neck portion 16 of the bolt 2 engages with the locking mechanism feature 8 of the door unbolting lever 9.

Figure 2B:
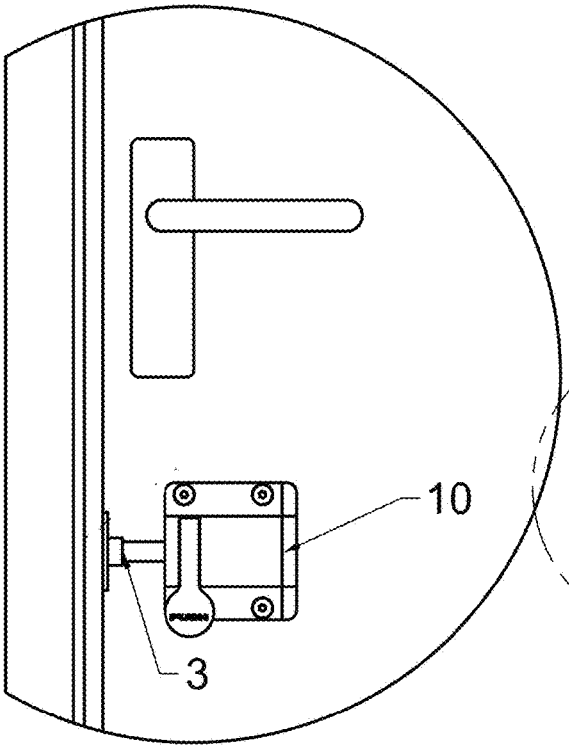
FIGS. 2A and 2B illustrate a front view of the deadbolt device of the present invention mounted on the inside of a door using a deadbolt keeper on the door frame to engage with the deadbolt.
Figure 2A:
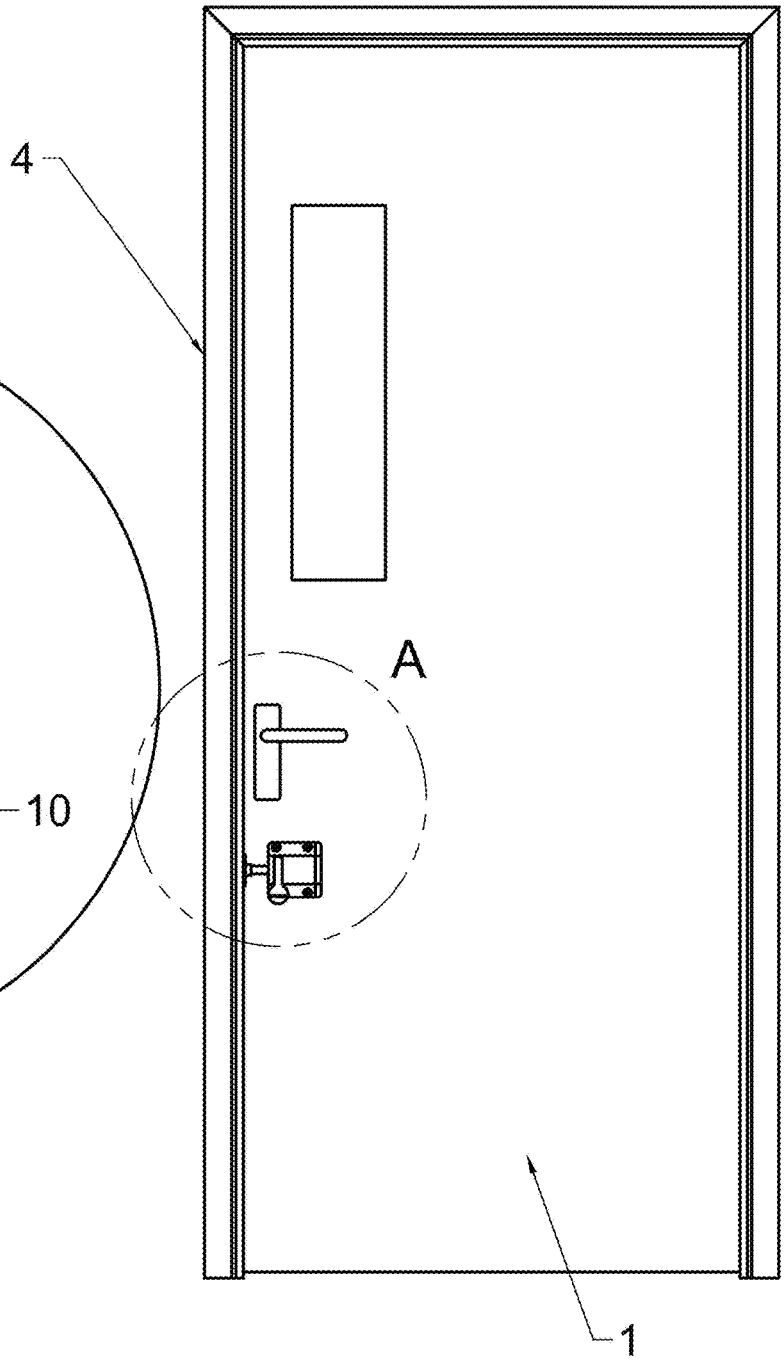

FIGS. 2A and 2B illustrate one configuration for mounting and employing the deadbolt device 100 on a door 4. As shown, with the deadbolt device 100 mounted on the door 4, one optional implementation uses a door deadbolt keeper 3 that is affixed to the frame of the door 4. In this configuration, the deadbolt device 100 is positioned and then mounted on the door 4 such the deadbolt 2 extends toward the frame of the door 4 and fits within the deadbolt keeper 3 mounted on the frame.

Figures 3A, 3B:
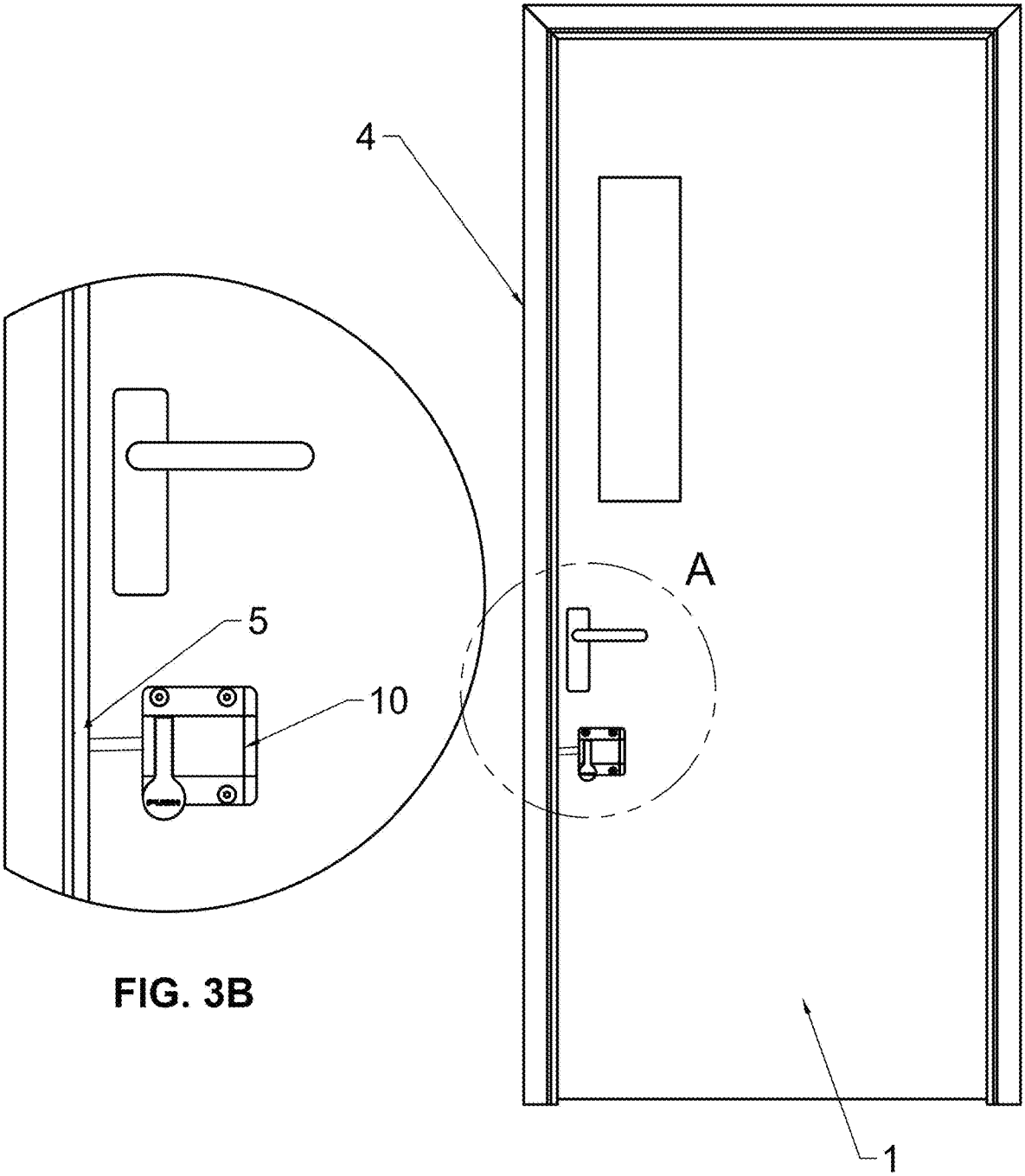
FIGS. 3A and 3B illustrate a front view of the deadbolt device of the present invention mounted on the inside of a door using a hole in the door frame to engage with the deadbolt.

Alternatively, as illustrated in FIGS. 3A and 3B, instead of a deadbolt keeper, a hole 5 may be drilled into the door frame 4 to retain the deadbolt 2 in the bolted position. In this configuration, the deadbolt device 100 is positioned and then mounted on the door 4 such the deadbolt 2 extends toward the frame of the door 4 to fit into the hole defined in the frame.

With reference to FIG. 1, a locking neck portion 16 of the deadbolt 2 is formed to engage the locking mechanism 8 or other similar mechanism to keep the deadbolt 2 in the locked position under tension of the deadbolt spring 6. In at least one embodiment, the locking neck portion 16 is composed of a portion of the length of the deadbolt 2 that has a narrower diameter than the remainder of the length of the deadbolt 2. In at least one embodiment, the locking neck portion 16 is formed by machining. The locking mechanism 8 is formed on door unbolting lever 9 to extend into the bore 19 through the lever slot 10*a*. The unbolting lever 9 is hinged in the lever slot 10*a* and mounted with the unbolting lever spring 17 in a compressed state, wherein the lever spring 17 rotatively urges the unbolting lever 9 and thus the locking mechanism 8 into the bore 19. As the deadbolt 2 slides into the bore 19, the locking neck portion 16 will pass by the lever slot 10*a* and engage with the locking mechanism 8. Pushing down on the button portion 9*a* rotatively disengages the locking mechanism 8 from the locking neck portion 16, which then releases the deadbolt 2 and the compression of the deadbolt spring 6. The deadbolt 2 is released but retained within the deadbolt housing 10.

Figures 4A, 4B:
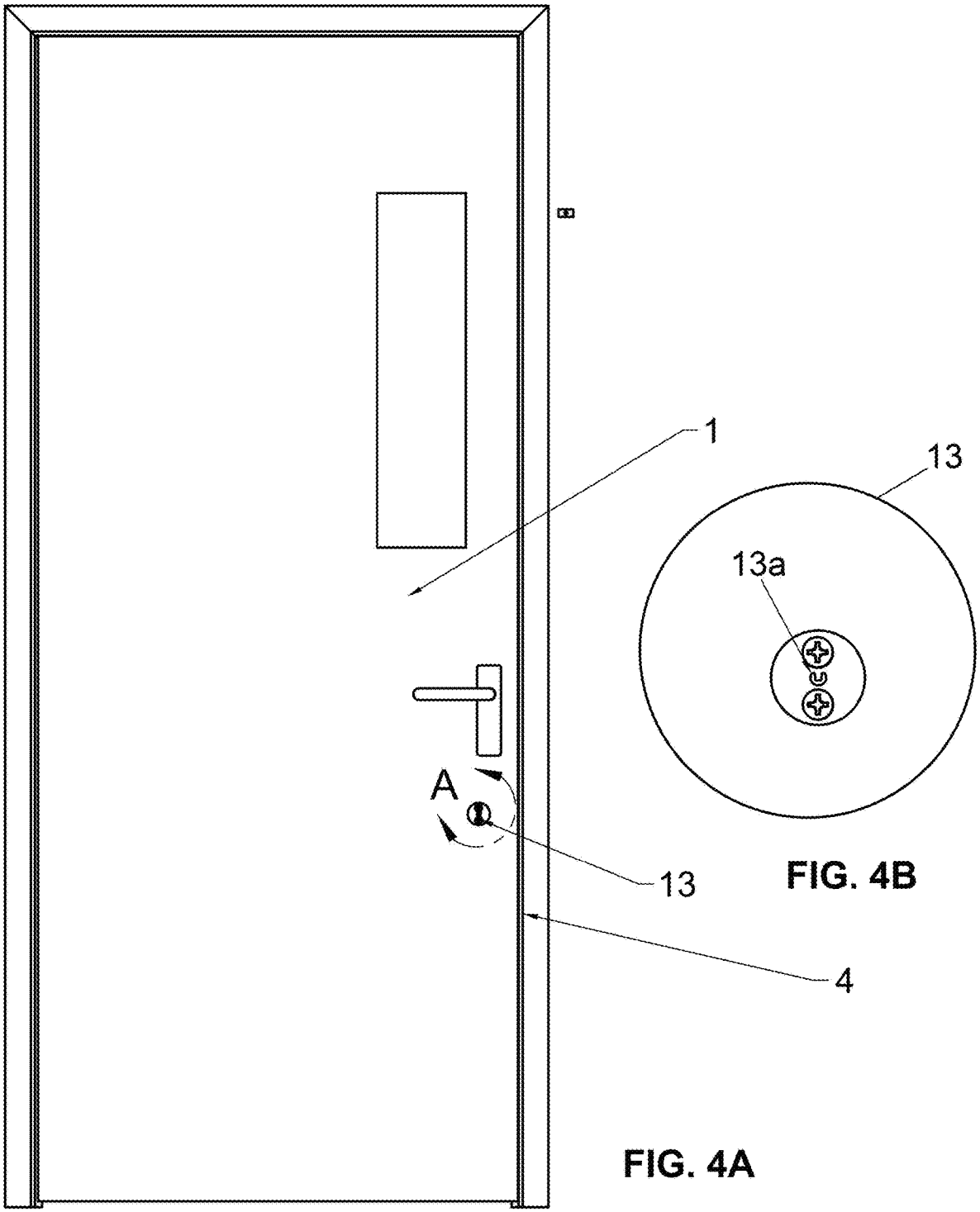
FIGS. 4A and 4B illustrate a front view of the deadbolt device keyhole cover and keyhole access optionally installed and mounted on the outside of a door.
Figure 5A:
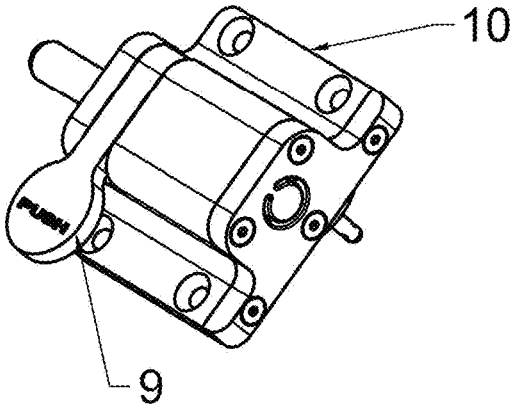
FIGS. 5A to 5C illustrate front perspective, rear perspective and top views of the deadbolt device of the present invention.
Figure 5B:
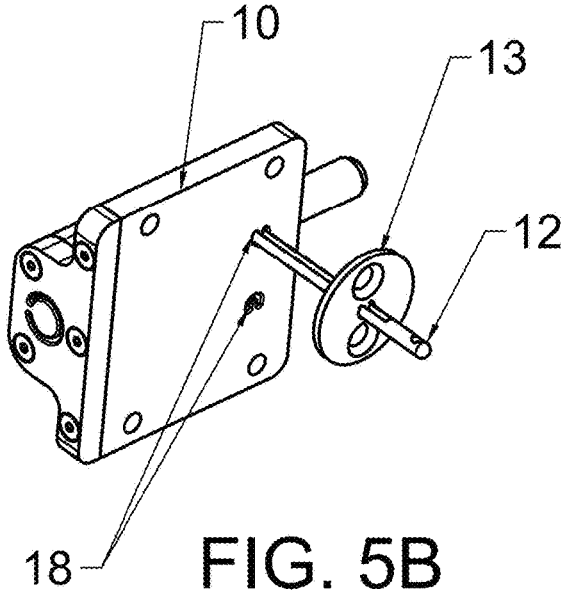
Figure 5C:
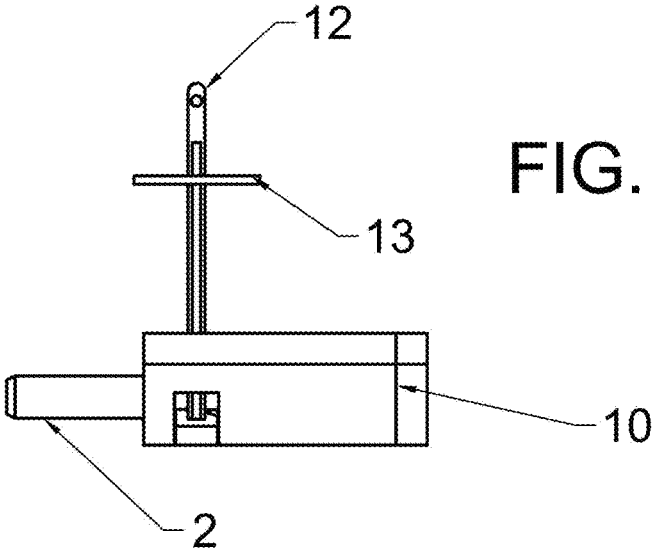

As shown in FIGS. 5A to 5C, an outside unlocking keyway 18 is a hole machined on the opposite side of the deadbolt device housing 10. An unlocking key tool 12 may be inserted into the keyway 18 to push against the unbolting lever 9 in the same manner as pushing against the button portion 9*a* to rotatively disengage the locking mechanism 8 from the locking neck portion 16. As shown in FIGS. 4A and 4B, when the housing 10 is fixedly mounted on the door 4, a hole may be drilled into the door 4 enabling access to the keyway 18. A keyhole plate 13 may be mounted on the door 4 to cover the hole that extends through the door 4. In order to secure the keyway 18 from being used by children or unauthorized persons, the keyway 18 may be formed as an oddly-shaped hole (i.e., star-shaped, U-shaped), and the unlocking key tool 12 is formed with a correspondingly odd shape so as to fit into the keyway 18. Further, a keyhole 13*a* defined on the keyhole plate 13 may also be formed as a corresponding oddly-shaped hole so that the unlocking key tool 12 may fit through the keyhole 13*a* and into the keyway 18. This is in addition to making the unlocking key tool 12 available or accessible only to select school officials (i.e., school principle, school security) or to first responders.

Figure 6:
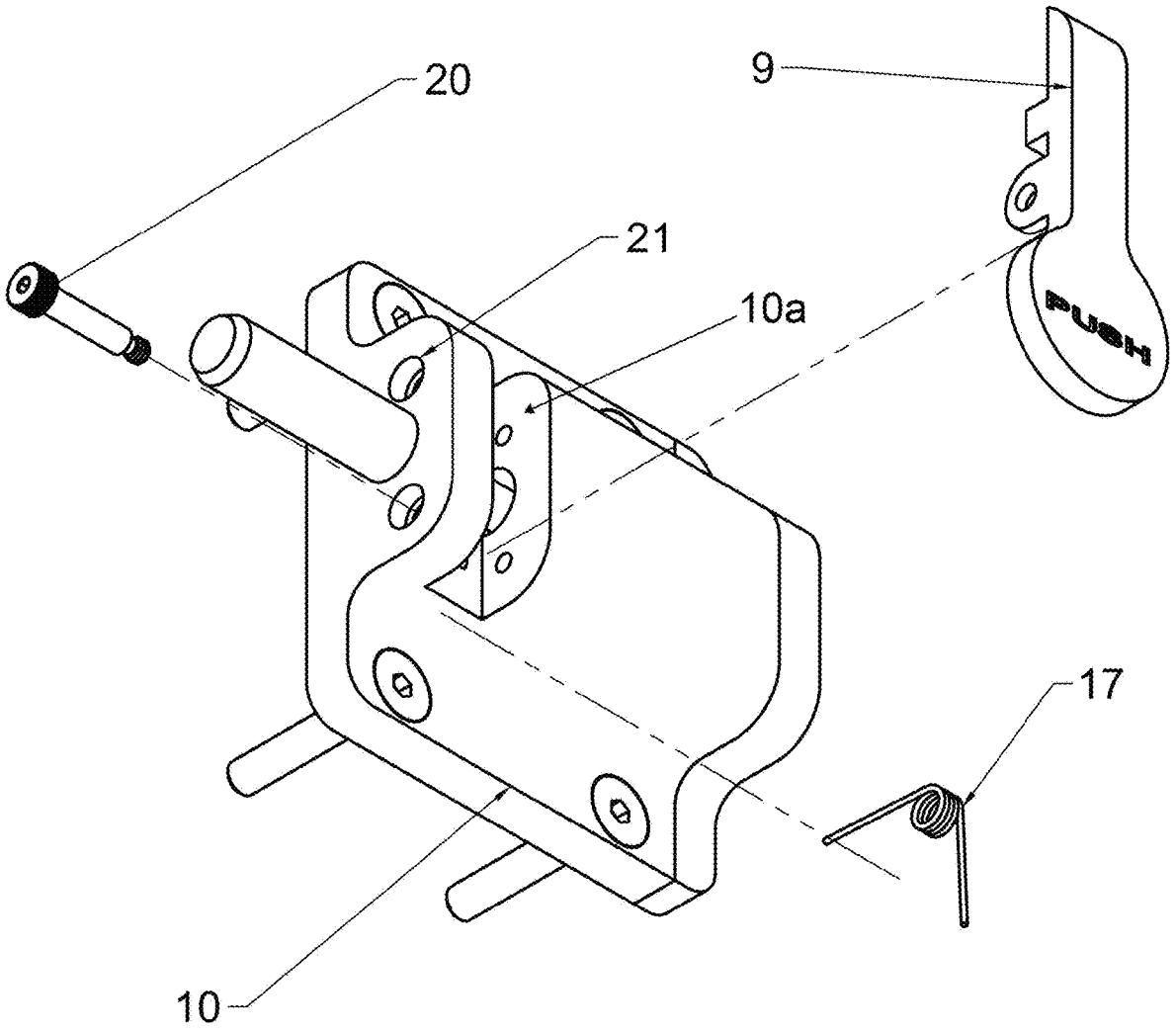
FIG. 6 shows a partial exploded perspective view of the deadbolt device of the present invention.

FIG. 6 shows a partial exploded perspective view of the deadbolt device 100. In this configuration, the deadbolt 2 is shown in the fully extended position as if the deadbolt 2 were engaged with the deadbolt keeper 3 or the hole 5, while the locking neck portion 16 of the deadbolt 2 is aligned with the lever slot 10*a* allowing it to engage the locking mechanism 8 or other similar mechanism and keep the deadbolt 2 in the locked position under tension of the deadbolt spring 6. The unbolting lever 9 that is hinged in the lever slot 10*a* and mounted under tension with the unbolting lever spring 17 in a compressed state, wherein the lever spring 17 rotatively urges the unbolting lever 9 and thus the locking mechanism 8 into locking neck portion 16 in the lever slot 10*a*.

Figure 7A:
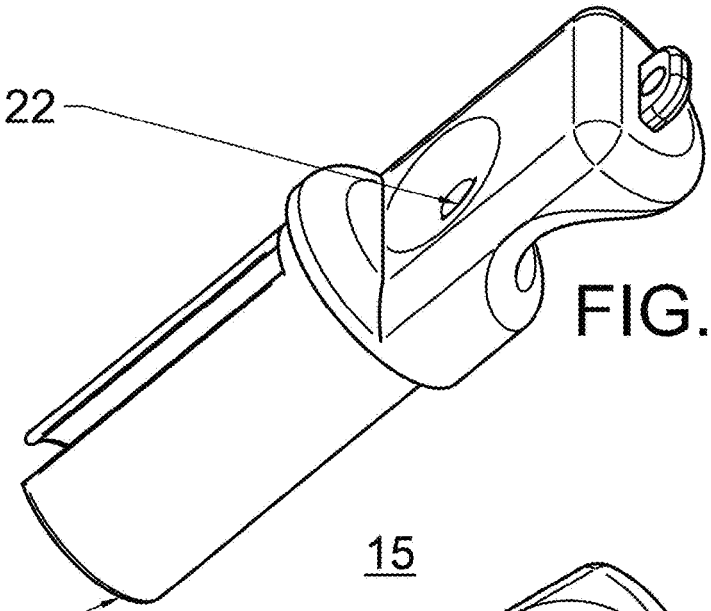
FIGS. 7A and 7B show perspective views of at least one embodiment of the key or tool according to the present invention.
Figure 7B:
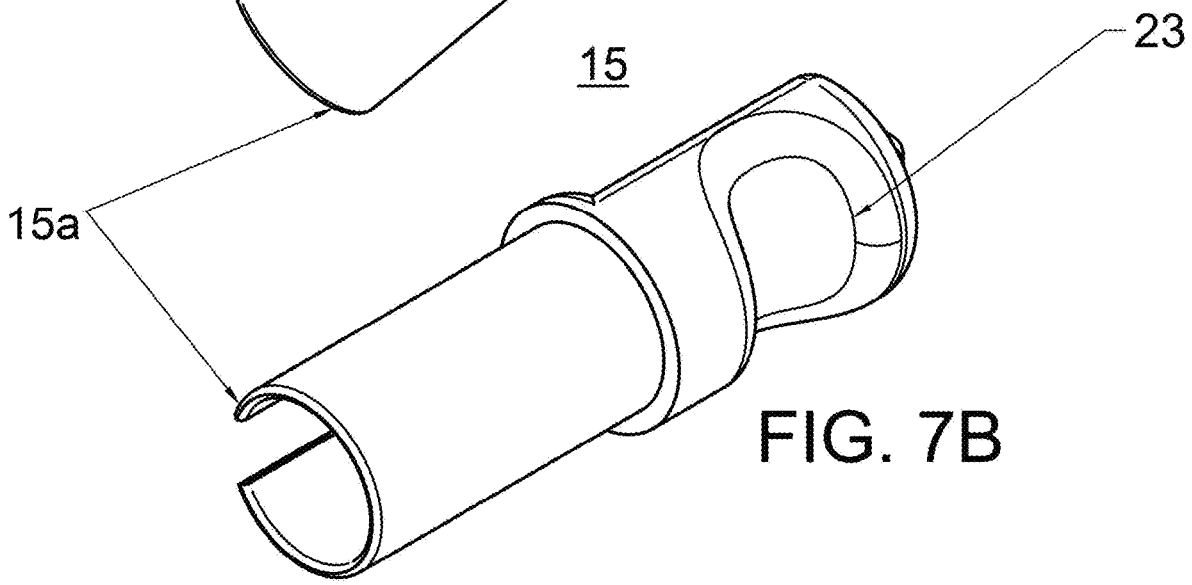

FIGS. 7A and 7B show perspective views of at least one embodiment of the removable key or tool 15 according to the present invention. The removable key or tool 15 is at least composed of main key body 15*a*, a thumb portion 22 of the handle 24, and a finger groove 23 of the handle 24. In general, a user would grasp the key or tool 15 using the thumb and index finger to firmly control the key or tool 15. The handle 24 is a special crescent shape designed to facilitate clocking and homing the key body 15*a* into the keyhole slot 14*a*. Clocking of the crescent shaped handle 24 is accomplished by the finger groove 23 on the handle 24. The grasp of the index finger and thumb on the finger groove 23 and the thumb portion 22, respectively, of the handle 24 naturally clocks the activator 2*a* in the right direction. The key body 15*a* is formed as a hollow cylindrical tube. In addition, the activator 2*a* of the deadbolt 2 may have a slight funnel shape (not shown). The end portion of the key body 15*a* may also have an opposing but corresponding funnel shape such that the corresponding portions of the activator 2*a* and the key body 15*a* align with one another clocking the key or tool 15 into position in the keyhole slot 14*a* with the deadbolt 2. This configuration allows a user to easily control the key or tool 15 when inserting into and then withdrawing from the bore 19.

Figure 8A:
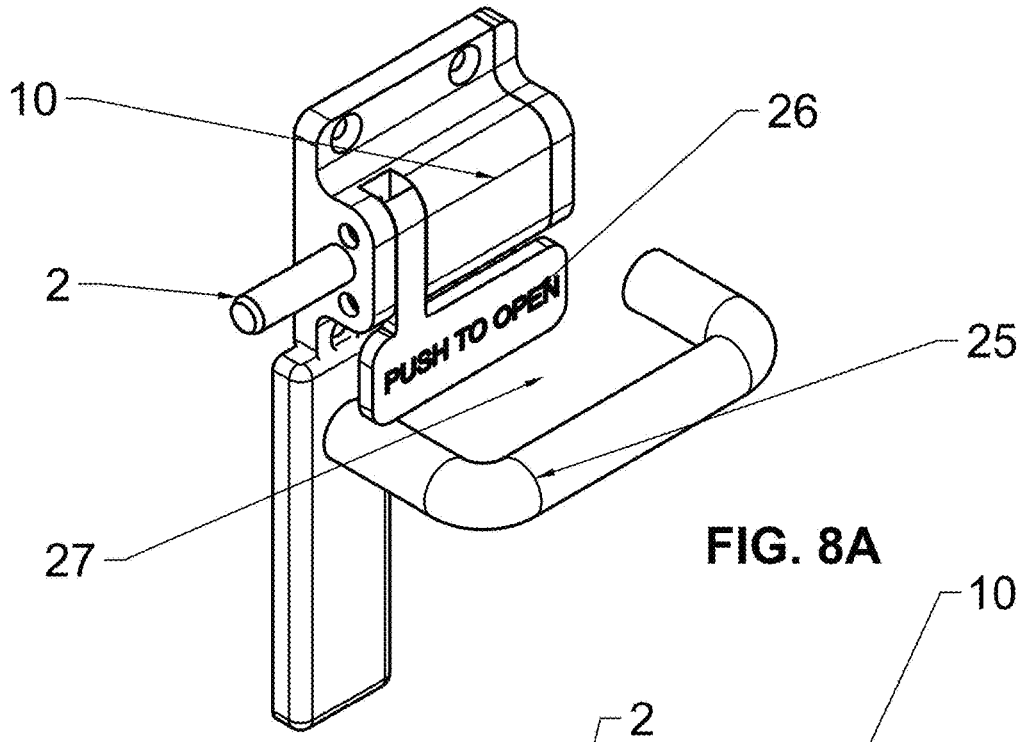
FIGS. 8A to 8C show perspective, front and left side views respectively of the deadbolt device according to another embodiment the present invention.
Figure 8B:
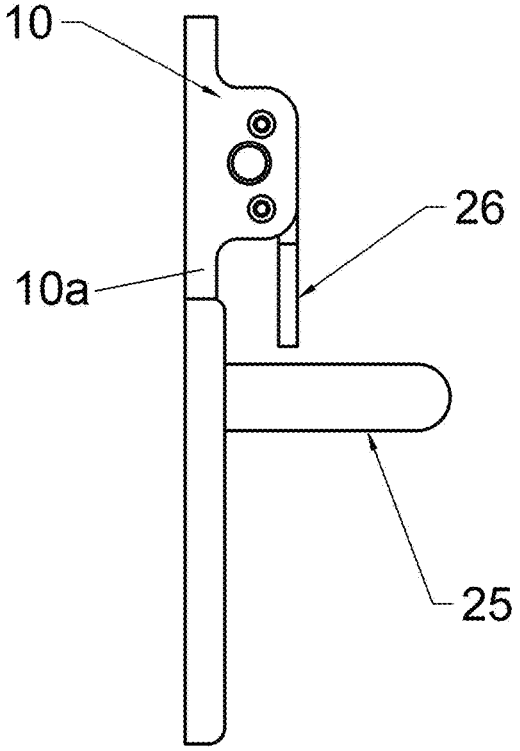
Figure 8C:
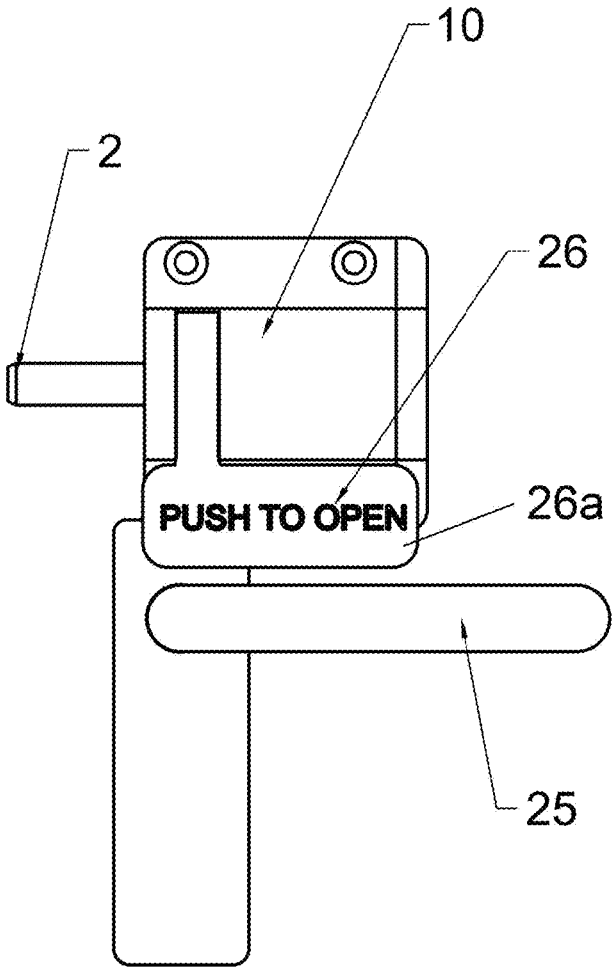

As shown in FIGS. 8A to 8C, in another embodiment of the present invention, the deadbolt device 100 is formed with the assembly housing 10 so as to be fixedly attached to a conventional doorknob mechanism 27 via a housing extension 10*a*, wherein the door handle 25 is positioned with the door unbolting lever 26 so as to facilitate a user operating the deadbolt device 100 and the doorknob mechanism 27 with minimum physical action or motion. The deadbolt 2 may also be formed to be slightly longer to accommodate the doorknob mechanism 27 being mounted on a door according to conventional doorknob mechanism dimensions and local building regulations. To achieve the function of operating the deadbolt device 100 and the doorknob mechanism 27 with minimum physical action or motion, the door unbolting lever 26 is formed as a wide horizontally-oriented rectangular strike plate 26*a* with the door handle 25 formed as a long tubular handle that in the stationary position is horizontally aligned with the orientation of the rectangular plate of the door unbolting lever 26. When the door is securely locked with the deadbolt device 100, a user may unbolt the deadbolt device 100 and open the door by first pushing on the rectangular strike plate 26*a* of the door unbolting lever 26 with his/her hand or fist, and then quickly dropping the hand to rotate the door handle 25.

Figure 9A:
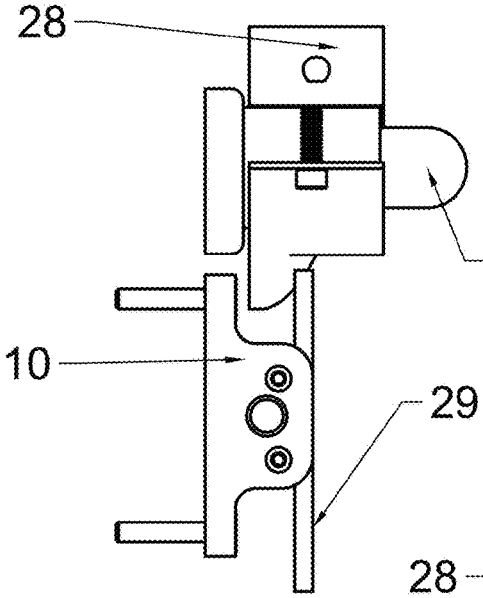
FIGS. 9A to 9C show left side, front side and perspective views respectively of the deadbolt device according to a further embodiment of the present invention.
Figure 9B:
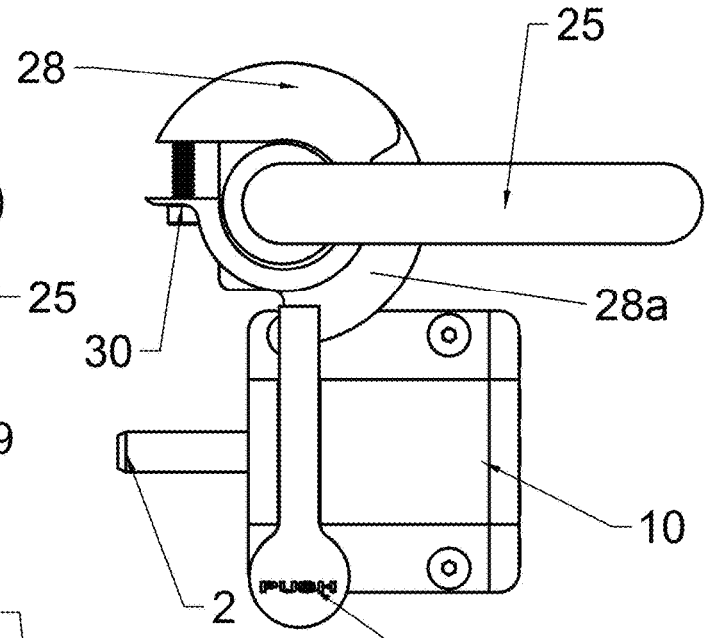
Figure 9C:
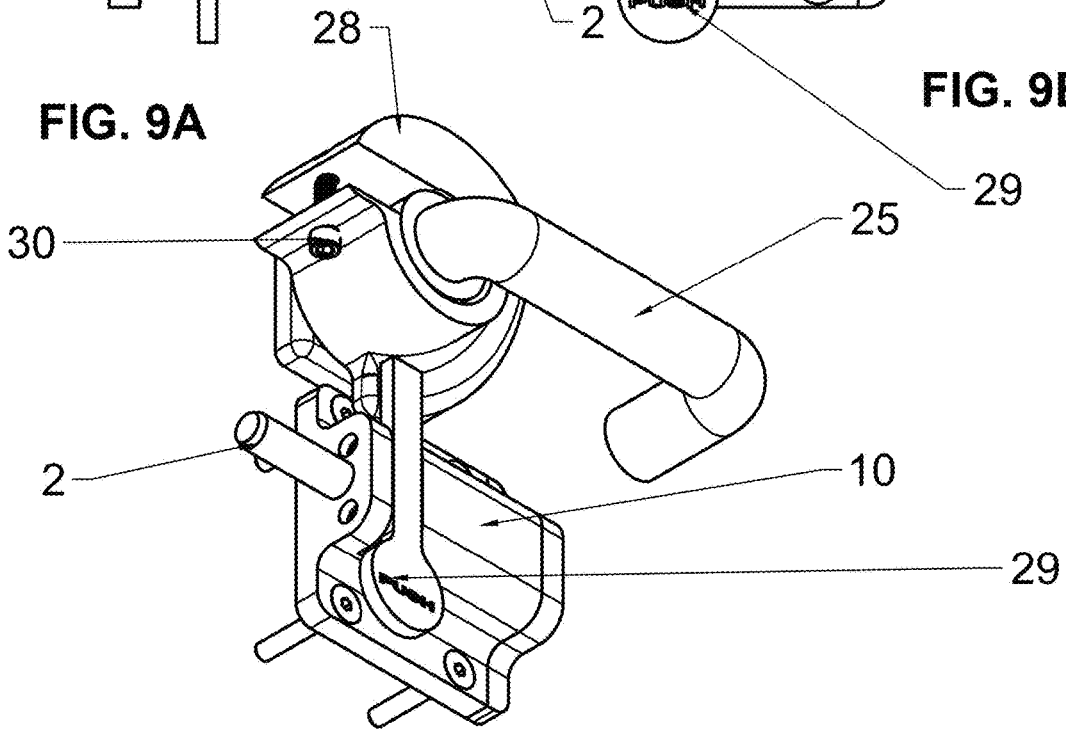

As shown in FIGS. 9A to 9C show left side, in a further embodiment of the present invention, the deadbolt device 100 is positioned adjacent to a conventional door handle 25, wherein a cam mechanism 28 is fixedly mounted on the door handle 25. The cam surface 28*a* is formed with a bottom portion thereof aligned to be in contact with a top portion of the door unbolting lever 29 of the deadbolt device 100. In operation, as the door handle 25 is turned clockwise, the cam mechanism correspondingly rotates clockwise, such that the top portion of the door unbolting lever 29 travels along the cam surface 28*a*. The top portion of the door unbolting lever 29 is pushed outward thereby operating the door unbolting lever 29 to release the bolt 2. As a result, the deadbolt device 100 can be unlocked simultaneously with the same motion as the turning of the door handle 25 to open the door.

Figure 10:
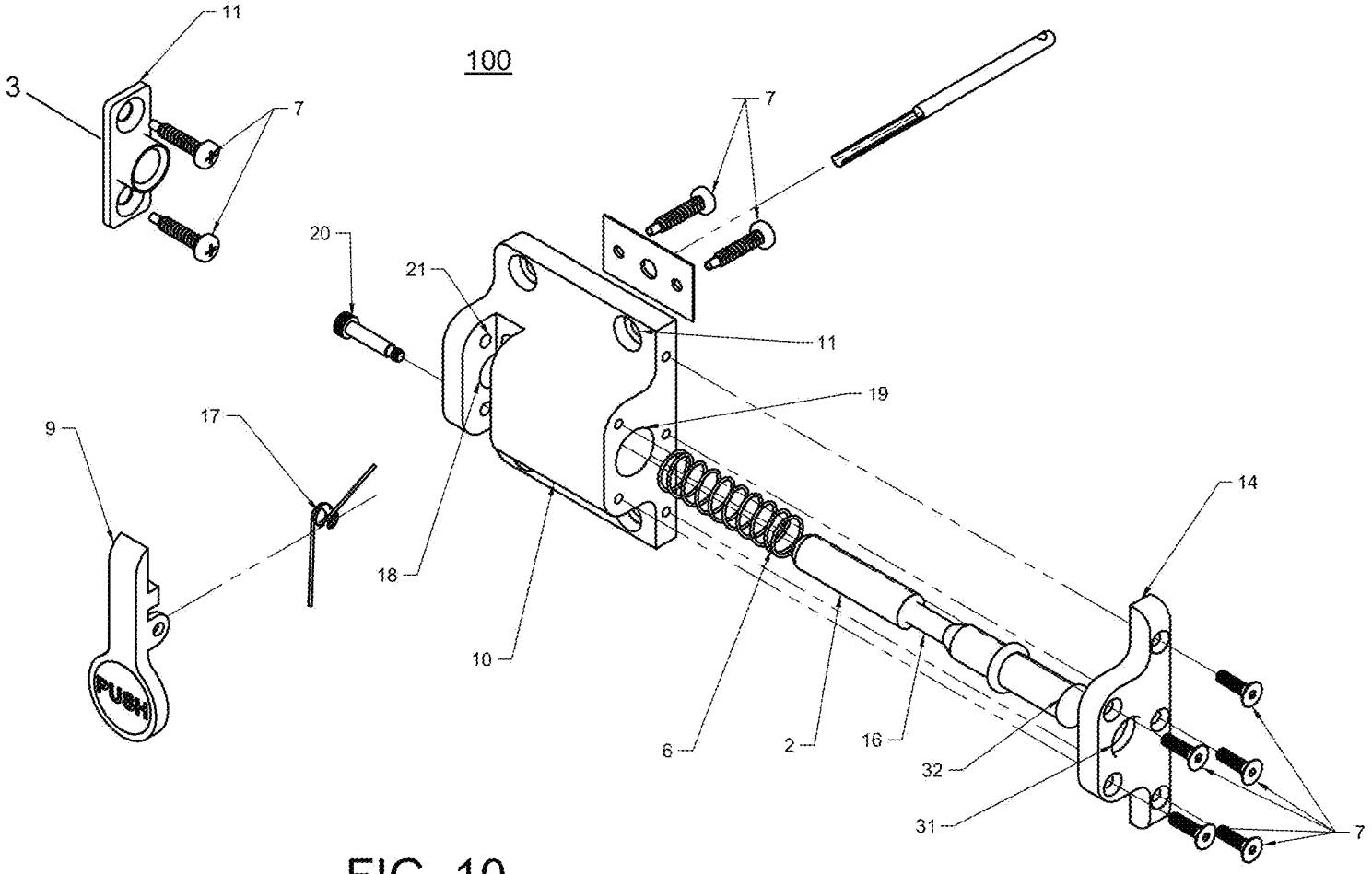
FIG. 10 shows a partial exploded perspective view of another embodiment of the deadbolt device of the present invention.

FIG. 10 shows a partial exploded perspective view of an even further embodiment of the deadbolt device of the present invention. The primary elements of the deadbolt device 100 remain the same, wherein the deadbolt device 100 has an assembly housing 10 to be used with a door 1 (see for example FIG. 2A); a tamper resistant plate 14; a deadbolt 2; a deadbolt keeper 3; a door unbolting lever 9; mounting hardware comprising metal screws 7, affixing through housing 10 and deadbolt keeper drill holes 11; and an outside unlocking key tool 12. The door unbolting lever 9 comprises a locking mechanism 8 capable of locking the deadbolt 2 in place under pressure from the deadbolt spring 6 which also secures the deadbolt 2 into its engaged position. The deadbolt 2 is further formed with a locking button extension 32 that extends out of the keyhole slot 31.

To lock the bolt, a user need only push the locking button extension 32 into the keyhole slot 31 in the tamper resistant plate 14 pushing the deadbolt 2 to slide through the bore 19 in the assembly housing 10 under tension of the deadbolt spring 6, until it is locked into position when the locking neck portion 16 of the bolt 2 engages with the locking mechanism feature 8 of the door unbolting lever 9. All other elements and functions of the deadbolt device 100 according to this embodiment are otherwise consistent with those of the previous embodiments disclosed hereinabove.

Figure 11:
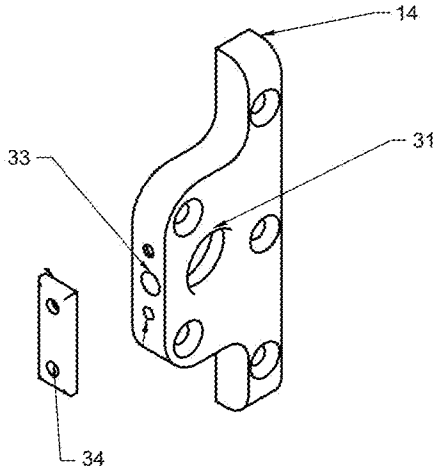
FIG. 11 shows a perspective view of another embodiment of the tamper resistant plate according to the present invention.

FIG. 11 shows a perspective view of an embodiment of the tamper resistant plate 14 wherein the plate 14 includes a wireless electronic device 34 that may be used to incorporate various functions. For example, the electronic device 34 may be a RFID device to keep track of the presence or location of the deadbolt device 100. In another example, the electronic device 34 may be a RFID device that senses the presence of a user that is carrying a wireless transmitter that identifies the user as being authorized to use the deadbolt device 100. Alternatively, the tamper resistant plate 14 may also include an access hole 33 through which the electronic device 34 can detect the presence of the key or tool 15 being inserted, or the movement or position of the locking button extension 32. In any of the above example embodiments of the electronic device 34, the electronic device 34 may also include wireless electronics that can be interrogated or be in constant communication with a remote central security station that monitors the status and/or location of all deadbolt devices in an area or building.

Figure 12:
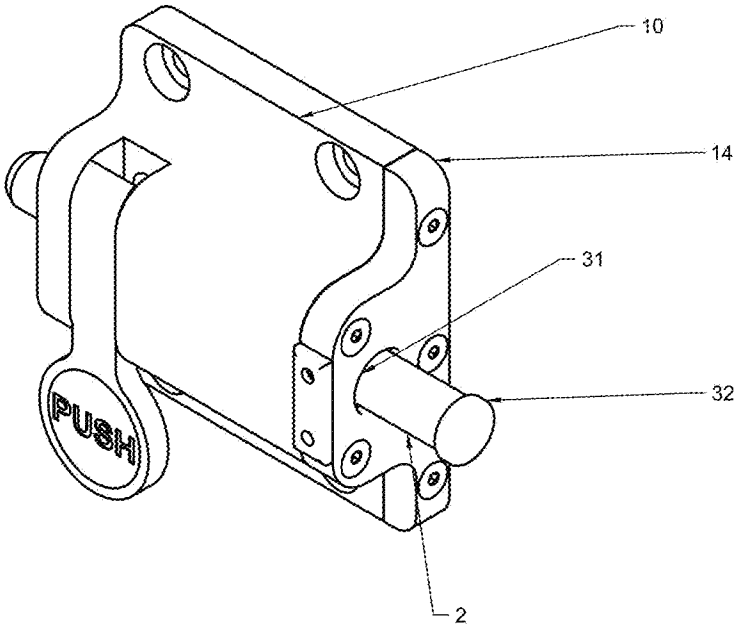
FIG. 12 shows a perspective view of the locking button extension embodiment of the deadbolt device incorporating further features according to the present invention.

FIG. 12 shows a perspective view of the embodiment of the deadbolt device 100 that incorporates the locking button extension 32 and the electronic device 34.

Figure 13:
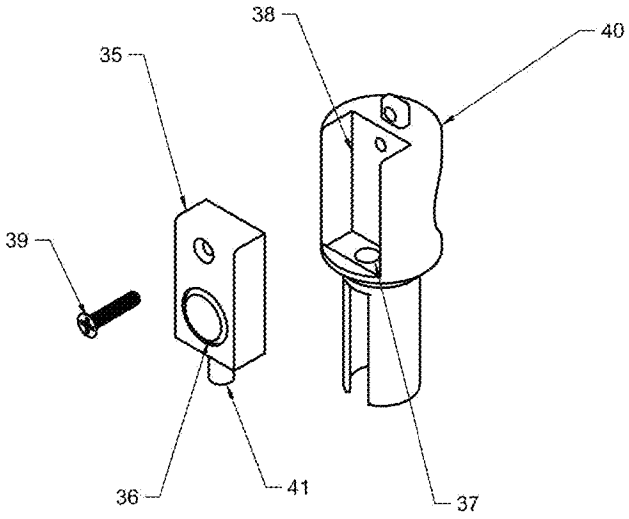
FIG. 13 shows an exploded perspective view of another embodiment of the key or tool according to the present invention.

FIG. 13 illustrates an exploded view showing the assembly of an enhanced wireless key or tool. Similar to the key or tool 15 of the previous embodiments described above, this key or tool of this embodiment is also configured to be able to push the deadbolt 2 into the locked position by inserting it into the assembly housing 10 and pushing bolt forward through the bore 19. Also like the previous embodiments of the key or tool 15, this embodiment has a crescent or other shape in order to discourage tampering by unauthorized persons. Unlike the previous embodiment, this embodiment incorporates a wireless key or tool 40. The wireless key or tool 40 includes a wireless module 35 containing switches, software and electronics that fits in the recess 38 in the wireless key or tool 40. The recess 38 is formed from a section in the handle of the key or tool 40. The recess 38 includes a hole 37 in the key or tool 40. The hole 37 is designed to accommodate a plunger 41 or other type of switch connected to the module 35 to access the hollow key body 15. In one implementation of the plunger 41, the plunger 41 operates as a momentary ON/momentary OFF switch when the key or tool 40 is pushed into the bore 19.

Example uses for the wireless key or tool 40 include a RFID tag that interrogates the electronic device 34 in deadbolt device 100 so as to identify the user as being authorized to operate the deadbolt device; or a transmitter that communicates with a remote central security station monitoring the status and/or location of all deadbolt devices in an area or building. In a further example of the use of the wireless key or tool 40, the electronic device 34 may include a solenoid switch or latch (not shown) that engages with the deadbolt 2 through the access hole 33 in the tamper resistant plate 14. The electronic device 34 interrogates the wireless key or tool to determine if the user is authorized to access the deadbolt device 100. If the user has authorization, the electronic device 34 releases the solenoid switch or latch, thereby allowing the user to operate the deadbolt device 100. At the same time, the electronic device 34 or the wireless key or tool 40 may be communicating with the remote central security station to indicate that a user is about to access a specific deadbolt device, an unauthorized person is attempting to use the deadbolt device, the deadbolt device has been engaged or disengaged, or even the deadbolt device is requesting authorization to engage or disengage its solenoid switch or latch.

Figure 14:
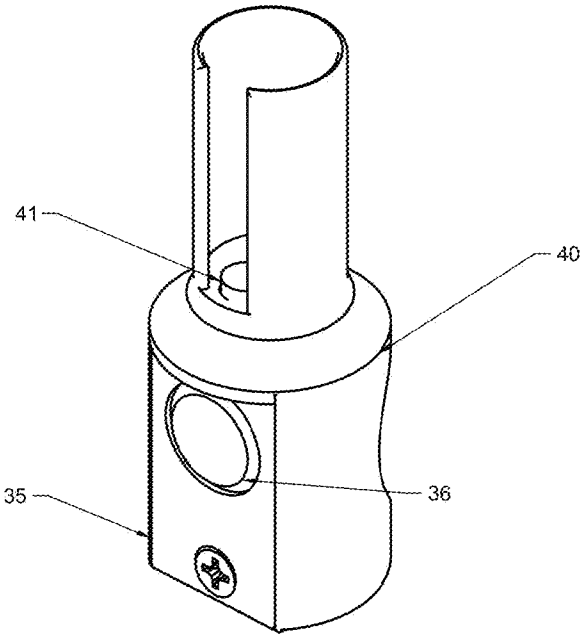
FIG. 14 shows a perspective view of another embodiment of the key or tool incorporating further features according to the present invention.

FIG. 14 shows a perspective view of an assembled wireless key or tool 40 with the wireless module 35 that contains an active switch 36 that the user presses to signal an emergency event and plunger 41 which operates as a switch. The action of inserting the wireless key or tool 40 into the keyway hole engages the plunger 41 to then trigger a switch in the electronic device 34 to then generate a wireless signal. In this configuration, the triggering of the plunger 41 is passive and a by-product of the user's action to engage the deadbolt device 100. The plunger 41 may be configured as an instant trigger. The plunger 41 is protected against accidental engagement because it is inside the cylindrical portion of the key or tool 40. Alternatively, the user may trigger a different signal by use of the press of the active switch 36, such as those describe hereinabove. The wireless module 35 in the key or tool 40 contains software, hardware, and electronics necessary to communicate the triggering of a signal directly to the remote central security station or through a relay, hub, or other communications device which can be monitored by a collector, computer, concentrator or other device.

Figure 15:
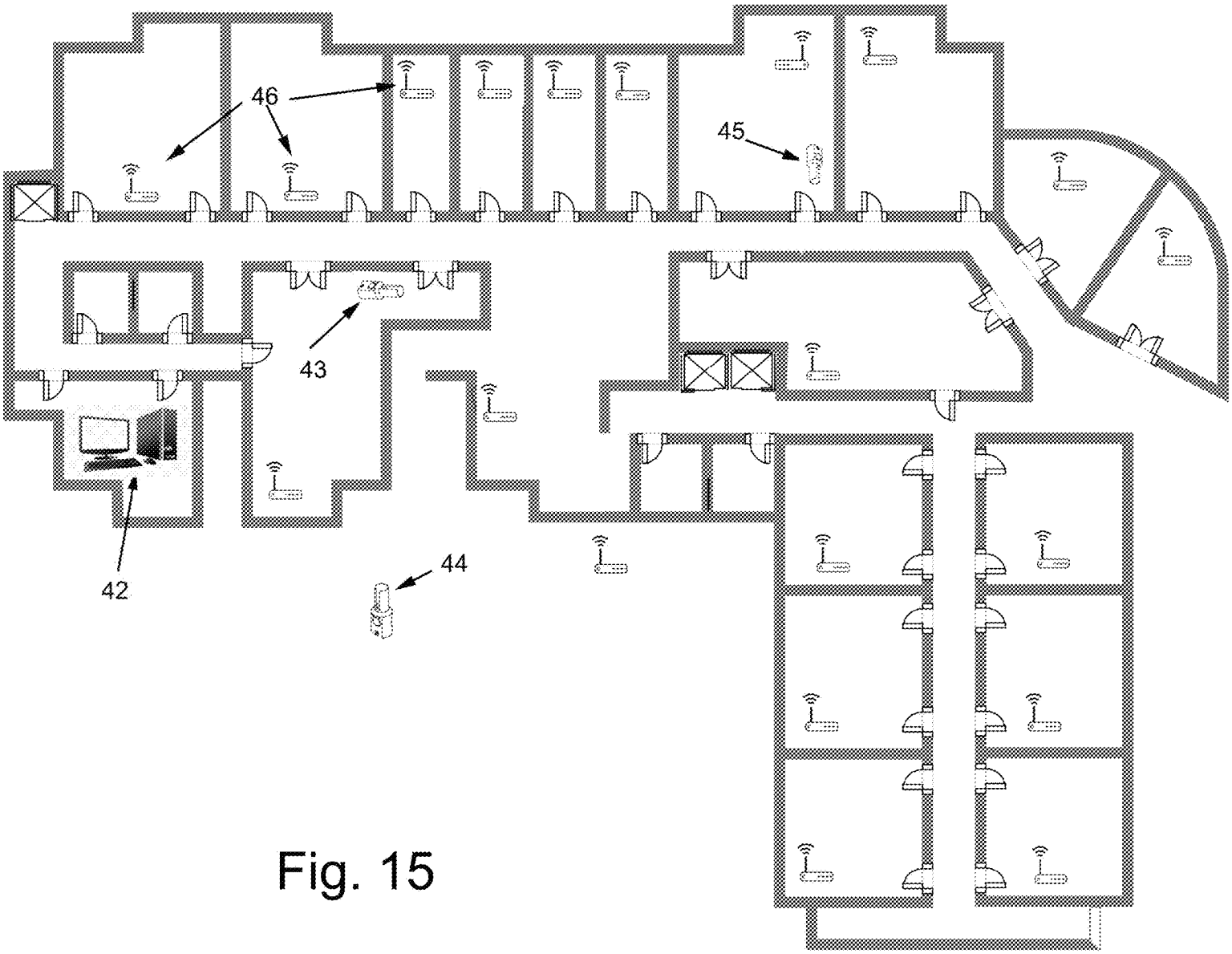
FIG. 15 illustrates a general layout of a school, office or other facility that implements a system having a plurality of deadbolt devices and wireless keys or tools according to the present invention.

As shown in FIG. 15, a school, office or other facility is equipped with a system wherein a plurality of interior doors each have the deadbolt device 100, a number of authorized users are given wireless keys or tools 43-45, and a remote central security station monitors the presence and condition of all the devices. Rooms equipped with doors that have the deadbolt device 100 may also have wireless antennas, relays routers, extenders or other devices 46 that can communicate with or monitor the deadbolt devices 100 in or near the room. In the case of a school, the wireless key or tool may be held by a user in the school cafeteria 43, or a classroom 45 or a user who is outside at the school playground or courtyard 44. In the event of a switch being triggered by either insertion into a deadbolt device 100 or by active pressing of the alert button 36 on any of the wireless keys or tools 43,44,45, a relay, hub, or other communications device 46 will forward a signal to the remote central security station within the school or even to the office of local first responders. Any number of resultant events from such a trigger could happen by use of specialized software for the purpose including automatically dialing and messaging a 911 distress call, sending a signal back to all devices to alert all users of an emergency. When users are alerted of an emergency, and as a result, lock their doors, this information is collected and transmitted as well.

In preferred embodiments of the present invention, the deadbolt device 100 of the present invention is primarily intended to increase the security of the room in which it is installed especially in rapid deployment situations such as a school or institution lockdown while inhibiting unauthorized entry. The locking mechanism is prevented from being engaged without a special tool carried or secured by the authorized user. For example, classroom doors are left unlocked during the day. However, in an emergency, the doors need to be rapidly locked preferably with a one-handed motion under a potentially stressful situation when there is little time. The door locking device of the present invention allows a user to easily lock a door from inside the room by pushing on the bolt with a special tool and locking the bolt into place. The bolt can be unlatched from the inside with a single, one handed motion which is required by most building, fire, and accessibility regulations. This permits intuitive and unencumbered egress from the room by means of a button press or pull. In a situation where emergency personnel or others are required to gain entry to the room, the deadbolt device of the present invention may be optionally configured during installation to be unlocked by use of a special tool from outside of the door.

Figure 16:
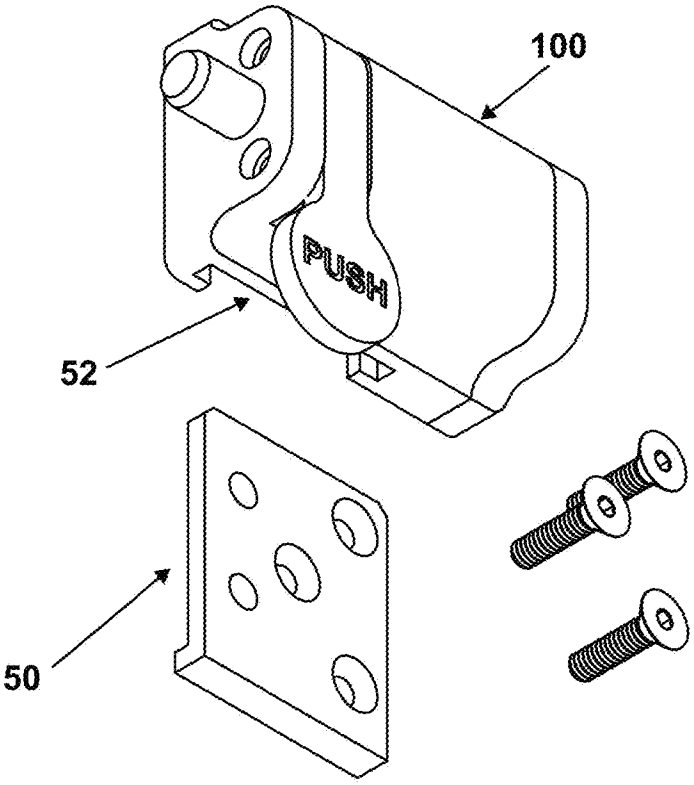
FIG. 16 illustrates an exploded perspective view of another embodiment of the deadbolt device using a mounting plate according to the present invention.

As shown in FIG. 16, another embodiment of the deadbolt device 100 incorporates a mounting plate 50 that is attached to the door 1 so as to be positioned between the door 1 and the deadbolt device 100. The assembly housing 10 is formed with a vertical mounting slot 52 into which the mounting plate 50 slidably fits when the deadbolt device 100 is attached on the mounting plate 50. The mounting plate may be formed with a beveled or chamfered edge and the vertical mounting slot 52 may be formed with a corresponding beveled or chamfered outer walls so that the deadbolt device 100 can slidably connect with the vertical mounting slot 52. At the same time, the deadbolt device 100 can be tightly fixed on the mounting plate 50. This structure allows the user to remove the deadbolt device 100 from the door 1 during normal use of the door 1, while making it easy for the user to quickly attach the deadbolt device 100 onto the mounting plate 50, and then lock the deadbolt device 100 in an emergency. Operation of the deadbolt device 100 is otherwise consistent with the structure and operation of the deadbolt device 100 as disclosed hereinabove. Other variations to the design and shape of the mounting plate 50 and the corresponding vertical mounting slot 52 as would be known to those of skill in the art may also be used.

The foregoing discussion discloses and describes merely exemplary embodiments of the present invention. One skilled in the art will readily recognize from such discussion, that various changes, modifications and variations can be made therein without departing from the spirit and scope of the invention as defined in the present disclosure. Furthermore, while exemplary embodiments have been expressed herein, others practiced in the art may be aware of other designs or uses of the present invention. Thus, while the present invention has been described in connection with exemplary embodiments thereof, it will be understood that many modifications in both design and use will be apparent to those of ordinary skill in the art, and this application is intended to cover any adaptations or variations thereof. It is therefore manifestly intended that this invention be limited only by the present disclosure and the equivalents thereof.

We claim:

1. A deadbolt device for securing a room from an outside intruder, comprising:

an assembly housing having a bore, the assembly housing being fixedly mounted to a door;

a deadbolt slidably connected in the bore, the deadbolt including a first end and a second end;

a deadbolt spring operatively connected to the deadbolt to urgingly engage deadbolt away from a locked position of the deadbolt;

an unlocking lever movably mounted in the assembly housing to lockingly engage the deadbolt in the locked position; and a locking key configured to be removably insertable into the bore of the assembly housing so as to engage with the second end of the deadbolt and push the deadbolt longitudinally in the bore to a locked position while the deadbolt is urged by the deadbolt spring away from the locked position, wherein the unlocking lever lockingly engages with the deadbolt, the locking key being further configured to removably disengage out of the bore of the assembly housing and separated away from the assembly housing, the first end of the deadbolt being fixedly engaged with a door frame of the door when the deadbolt is the locked position, and the unlocking lever is configured to release engaging with the deadbolt so as to release the deadbolt away from the locked position.

2. A deadbolt device according to claim 1, wherein the deadbolt includes a locking neck portion and the unlocking lever includes a locking mechanism, wherein the locking mechanism of the unlocking lever engages with the locking neck portion when the deadbolt is in the locked position.

3. A deadbolt device according to claim 1, wherein the locking key includes a handle and a key body, the key body being a hollow, cylindrical tube, and the key body being formed to be removably insertable into the bore of the assembly housing so as to engage with the second end of the deadbolt and push the deadbolt.

4. A deadbolt device according to claim 1, further comprising:

a deadbolt keeper fixedly mounted on the door frame of the door and operatively positioned to receive the first end of the deadbolt when the deadbolt is in the locked position.

5. A deadbolt device according to claim 1, further comprising:

an electronic device fixedly connected to the assembly housing, the electronic device being at least one of a RFID device, a wireless transmitter/receiver and a wireless sensor.

6. A deadbolt device according to claim 1, wherein the locking key includes an electronic circuit fixedly mounted thereon, the electronic circuit being at least one of a RFID device, a wireless transmitter/receiver and a wireless sensor.

7. A deadbolt device according to claim 1, further comprising:

an outside unlocking keyway defined on an opposite side of the housing so as to be accessible from an outside position of the door, the keyway being formed in a geometric shape; and an unlocking key tool configured to be removable insertable into the keyway so as to release the unlocking lever engaging with the deadbolt and to release the deadbolt away from the locked position from the outside position.

8. A deadbolt device according to claim 1, further comprising:

a cam mechanism fixedly connected to a door handle on the door, the door handle being operatively connected to rotatively unlock the door with the cam mechanism correspondingly rotating with the door handle, the cam mechanism being operatively connected to the unlocking lever, wherein the unlocking lever slidably engages with the cam mechanism as the cam mechanism rotates with the door lever such that the unlocking lever releases engaging with the deadbolt so as to release the deadbolt away from the locked position simultaneously with the door handle rotatively unlocking the door.

9. A deadbolt device according to claim 1, wherein the assembly housing includes a housing extension fixedly connected to a door handle housing on the door, and the unlocking lever includes a strike plate, wherein the housing extension is configured such that the strike plate is operatively positioned adjacent a door handle on the door handle housing, wherein a user pushing the strike plate of the unlocking lever releases engaging with the deadbolt so as to release the deadbolt away from the locked position and the user can substantially simultaneously operate the door handle unlocking the door.

10. A system for securing rooms in a school or office from outside intruders, the system comprising:

a plurality of deadbolt devices each operatively mounted on interior doors in the school or office, each of the plurality of deadbolt devices including an assembly housing having a bore, the assembly housing being fixedly mounted to a door, a deadbolt slidably connected in the bore, the deadbolt including a first end and a second end, a deadbolt spring operatively connected to the deadbolt to urgingly engage deadbolt away from a locked position of the deadbolt, a unlocking lever movably mounted in the assembly housing to lockingly engage the deadbolt in the locked position, and an electronic device fixedly connected to the assembly housing, the electronic device being at least one of a RFID device, a wireless transmitter/receiver and a wireless sensor, wherein the unlocking lever lockingly engages with the deadbolt, the first end of the deadbolt being fixedly engaged with a door frame of the door when the deadbolt is the locked position, and the unlocking lever is configured to release engaging with the deadbolt so as to release the deadbolt away from the locked position;

a plurality of locking keys each configured to be removably insertable into the bore of the assembly housing in each of the plurality of deadbolt devices so as to engage with the second end of the deadbolt and push the deadbolt longitudinally in the bore to a locked position while the deadbolt is urged by the deadbolt spring away from the locked position, each of the plurality of locking keys including an electronic circuit fixedly mounted thereon, the electronic circuit being at least one of a RFID device, a wireless transmitter/receiver and a wireless sensor, and each of the plurality of locking keys being further configured to removably disengage out of the bore of and separated away from the assembly housing in each of the plurality of deadbolt devices; and a remote central security station wirelessly connected to each of the plurality of locking keys and plurality of locking keys so as to at least monitor the plurality of locking keys and plurality of locking keys.

11. A deadbolt device according to claim 1, further comprising:

a mounting plate fixedly attached to the door so as to be positioned between the door and the assembly housing, wherein the assembly housing includes a mounting slot defined thereon with a shape corresponding to the mounting plate such that the mounting plate slidably and fixedly connects with the mounting slot.

12. A deadbolt device according to claim 11, wherein the mounting plate is formed with at least one of a beveled and chamfered edge, and the mounting slot is formed with a corresponding beveled or chamfered wall.

13. A deadbolt device according to claim 10, further comprising:

a mounting plate fixedly attached to the door so as to be positioned between the door and the assembly housing, wherein the assembly housing includes a mounting slot defined thereon with a shape corresponding to the mounting plate such that the mounting plate slidably and fixedly connects with the mounting slot.

14. A deadbolt device according to claim 13, wherein the mounting plate is formed with at least one of a beveled and chamfered edge, and the mounting slot is formed with a corresponding beveled or chamfered wall.

* * * * *